US011007557B2

(12) United States Patent
Becker et al.

(10) Patent No.: US 11,007,557 B2
(45) Date of Patent: May 18, 2021

(54) SYSTEMS AND METHODS FOR REMOVING VISCOUS MATERIALS IN METAL ARTICLE PROCESSING

(71) Applicant: Novelis Inc., Atlanta, GA (US)

(72) Inventors: Heinz Werner Becker, Kingston (CA); Rejean Lemay, Kingston (CA); Andrew James Hobbis, Bath (CA); David Anthony Gaensbauer, Atlanta, GA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 16/440,643

(22) Filed: Jun. 13, 2019

(65) Prior Publication Data

US 2019/0381551 A1 Dec. 19, 2019

Related U.S. Application Data

(60) Provisional application No. 62/684,446, filed on Jun. 13, 2018.

(51) Int. Cl.
*B21B 45/02* (2006.01)
*B08B 7/00* (2006.01)

(52) U.S. Cl.
CPC ..... *B21B 45/0278* (2013.01); *B08B 7/00* (2013.01)

(58) Field of Classification Search
None
See application file for complete search history.

(56) References Cited

U.S. PATENT DOCUMENTS 3,200,629 A 8/1965 James et al.
4,458,376 A 7/1984 Sitko
4,601,112 A 7/1986 Kush et al.
4,691,549 A 9/1987 Adair
(Continued)

FOREIGN PATENT DOCUMENTS

CN 1148820 A 4/1997
CN 1633342 A 6/2005
(Continued)

OTHER PUBLICATIONS

International Search Report and Written Opinion issued in Application No. PCT/US2019/037041 dated Sep. 23, 2019, 8 pages.
(Continued)

*Primary Examiner* — Eric W Golightly
(74) *Attorney, Agent, or Firm* — Kilpatrick Townsend & Stockton LLP

(57) ABSTRACT

Provided herein are systems and methods for removing a viscous material from a material article. In particular, a viscous material removal system can include a seal and a biasing mechanism. The viscous material removal system can also serve as a viscous material containment system. The systems can provide viscous material removal from planar and non-planar articles, as well as articles having surface irregularities or a topography including ridges and valleys. A method for removing viscous materials can include contacting the seal to the material article, maintaining contact of the seal across a width of the material article via the biasing mechanism, and passing the material article over the seal, thus removing the viscous material from the material article.

16 Claims, 5 Drawing Sheets

(56) References Cited

U.S. PATENT DOCUMENTS

| | | | |
|---|---|---|---|
| 4,718,264 | A | 1/1988 | Guppy et al. |
| 4,796,450 | A | 1/1989 | Blazevic |
| 4,934,444 | A | 6/1990 | Frischknecht et al. |
| 5,524,465 | A | 6/1996 | Kajiwara et al. |
| 5,628,223 | A | 5/1997 | Denker |
| 6,302,004 | B1 | 10/2001 | Taylor |
| 2009/0255782 | A1 | 10/2009 | McBride |
| 2012/0031159 | A1 | 2/2012 | Seidel et al. |
| 2015/0020564 | A1 | 1/2015 | Kipping et al. |
| 2015/0020845 | A1 | 1/2015 | Dagner et al. |
| 2019/0217355 | A1 | 7/2019 | Freliez et al. |

FOREIGN PATENT DOCUMENTS

| | | | | |
|---|---|---|---|---|
| CN | 101155651 | A | 4/2008 | |
| CN | 101522930 | A | 9/2009 | |
| CN | 102665978 | A | 9/2012 | |
| CN | 204396466 | U | 6/2015 | |
| DE | 2038873 | B | 12/1971 | |
| DE | 102009053073 | A1 | 9/2010 | |
| DE | 102016204501 | A1 | 7/2017 | |
| EP | 0313516 | A1 | 4/1989 | |
| EP | 0340026 | A2 | 11/1989 | |
| EP | 0427359 | A2 | 5/1991 | |
| EP | 0794023 | A2 * | 9/1997 | ..... B21B 45/0251 |
| EP | 1142652 | A2 | 10/2001 | |
| FR | 3056419 | A1 | 3/2018 | |
| JP | S5410931 | U | 1/1979 | |
| JP | S63224806 | A | 9/1988 | |
| JP | H0232310 | A | 2/1990 | |
| JP | H06335714 | A | 12/1994 | |
| JP | H09239040 | A | 9/1995 | |
| JP | H07265916 | A | 10/1995 | |
| JP | 105827 | A | 1/1998 | |
| JP | 2008185203 | A | 8/2008 | |
| KR | 100254076 | B1 | 4/2000 | |
| KR | 20140010443 | A | 1/2014 | |
| KR | 20190015271 | A | 2/2019 | |
| RU | 2193936 | C1 | 12/2002 | |
| RU | 147615 | U1 | 11/2014 | |
| WO | 2005/115651 | A1 | 12/2005 | |
| WO | 2012/110241 | A1 | 8/2012 | |
| WO | 2015/086119 | A1 | 6/2015 | |
| WO | 2015169475 | A1 | 11/2015 | |
| WO | 2016/083128 | A1 | 6/2016 | |

OTHER PUBLICATIONS

International Search Report and Written Opnion issued in Application No. PCT/US2019/037036 dated Nov. 25, 2019, 13 pages.

International Search Report and Written Opinion issued in Application No. PCT/US2019/037039 dated Sep. 18, 2019, 15 pages.

"Oil Seal Material Chart", Barnwell The Seal of a Approval, Available Online at: https://www.barnwell.co.uk/oil-seal-materials/, 5 pages printed Aug. 4, 2020.

International Patent Application No. PCT/US2019/037036, International Preliminary Report on Patentability dated Dec. 24, 2020, 7 pages.

* cited by examiner

SYSTEMS AND METHODS FOR REMOVING VISCOUS MATERIALS IN METAL ARTICLE PROCESSING

CROSS-REFERENCE TO RELATED APPLICATION

The present application claims priority to and filing benefit of U.S. Provisional Patent Application No. 62/684,446, filed on Jun. 13, 2018, which is incorporated herein by reference in its entirety.

TECHNICAL FIELD

The present disclosure relates to metallurgy generally and more specifically to metal manufacturing.

BACKGROUND

Unless otherwise indicated herein, the materials described in this section are not prior art to the claims in this application and are not admitted to be prior art by inclusion in this section.

Existing processing methods can use a wiper to contain viscous materials (e.g., liquid cleaners, lubricants, coolants, pretreatments, or the like, or any combination thereof) applied to a rolled material product (e.g., a metal article) during and/or after processing steps performed requiring application of a viscous material (e.g., cleaning, lubricating, cooling, pretreating, or the like, or any combination thereof). In some cases, the rolled material product is not completely flat (i.e., planar) and can have a curved cross-sectional shape along its width and/or length. Additionally, the rolled material product can have surface irregularities including projections, depressions, or any other non-planar surface characteristics. Thus, when applying, for example, a liquid coolant to control a temperature of a metal article, subsequent complete removal of the liquid coolant using a rigid and/or non-compliant seal is ineffective or impractical.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Disclosed herein is a system for removing a viscous material from a surface of a material article, comprising: a flexible seal that is movable in a direction substantially normal to the surface along a width of the flexible seal between a first position and at least one second position, wherein the flexible seal is configured to contact the surface along the width of the flexible seal; and a biasing mechanism configured to move select portions of the flexible seal along the width of the flexible seal to conform the flexible seal to the surface across a width of the surface. In some examples, the system further comprises the material article, wherein the material article is at least one of a moving material article or a metal article. Additionally, the flexible seal may be movable in a direction normal to the material article along a width of the flexible seal between a first position and a plurality of other variable positions.

In some examples, the biasing mechanism is a static biasing mechanism or a movable biasing mechanism, wherein the movable biasing mechanism includes a plurality of portions that move independently of each other, or that move in concert with each other. In some aspects, the static biasing mechanism can be a curved bar, wherein a convex side of the curved bar contains a mount for the seal, wherein the seal can be pressed against the material article by positioning the curved bar adjacent to the material article. In some non-limiting examples, the movable biasing mechanism includes a plurality of actuators, a plurality of springs, or a fillable bladder (e.g., a bladder fillable with a gas, a liquid, a gel, or any suitable fluid medium, any combination thereof or any suitable biasing mechanism). In some cases, the system further includes a plurality of mounting devices, wherein an individual mounting device can be attached to an individual biasing mechanism (e.g., an individual actuator or an individual spring). Optionally, the plurality of mounting devices can be attached to the fillable bladder. In some examples, the plurality of actuators can be pneumatic actuators, electrical actuators, hydraulic actuators, mechanical actuators, magnetic actuators, thermal actuators, any combination thereof, or other suitable actuator. In some cases, the plurality of mounting devices can be clamps, clips, pins, clasps, any combination thereof, or any other suitable mounting device.

In some non-limiting examples, the biasing mechanism can extend at least a first portion of the flexible seal beyond at least a second portion of the flexible seal. The flexible seal can have a width sufficient to traverse at least partially across a width of the material article, and, in some cases, the flexible seal can traverse wholly across the width of the material article.

In some non-limiting examples, the seal further includes a contacting edge, a mounting edge, and a body, wherein the body is positioned between the contacting edge and the mounting edge, and the mounting edge is disposed opposite the contacting edge. In some cases, the body, the contacting edge, and the mounting edge can have any suitable cross-sectional shape, including but not limited to a line, a rectangle, a square, a triangle, a circle, an ellipse, a knife blade, or the Greek capital letter omega. In some aspects, the seal is a flexible seal that has a degree of flexibility such that the contacting edge conforms to a surface topography of the material article and/or any cross-sectional shape of the material article that can occur during processing.

Also disclosed herein is a method of removing a viscous material from a material article, including mounting a seal onto a biasing mechanism to provide a seal mounted on a biasing mechanism, placing the seal mounted on the biasing mechanism adjacent to the material article wherein a contacting edge of the seal contacts the material article, and applying pressure from the biasing mechanism such that the seal maintains contact with the material article. In some examples, the seal is placed adjacent to an area having a viscous material applied to the material article and passing the material article across the seal. In some cases, the biasing mechanism can allow the seal to conform to a cross-sectional shape of the material article and/or a surface topography of the metal article. In some cases, the viscous material applied to the material article cannot pass the seal.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
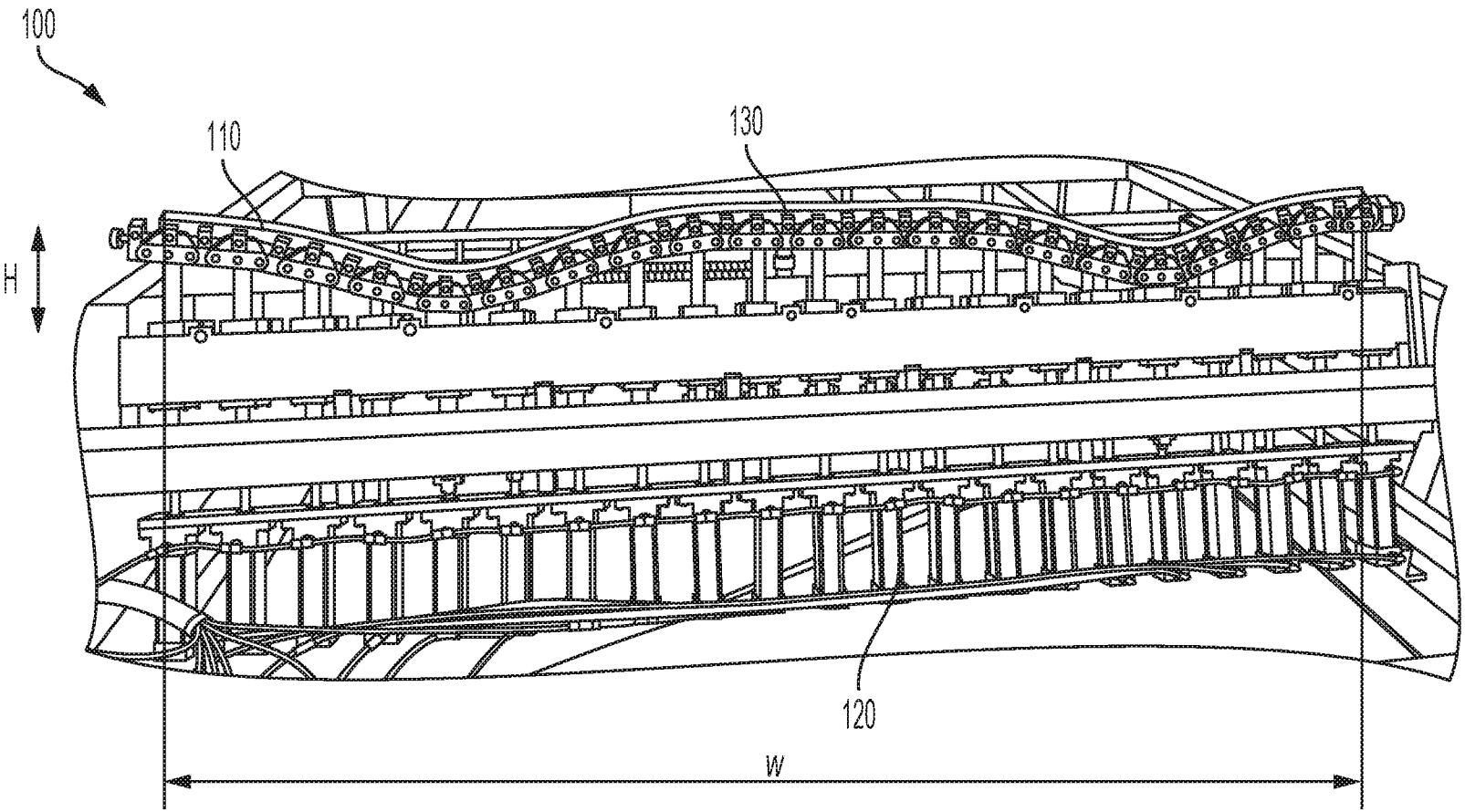
FIG. 1 is a schematic of a viscous material removal system according to certain aspects of the present disclosure.

Certain aspects and features of the present disclosure relate to rolling mills for rolling a metal article in a hot rolling mode, a cold rolling mode, a warm rolling mode, or any combination thereof. Further aspects and features of the present disclosure relate to systems and methods of cooling metal articles and/or work rolls involved in the hot rolling, cold rolling, or warm rolling. Still further aspects of the present disclosure relate to systems and methods for removing viscous materials (e.g., coolants, cleaners, pretreatments, lubricants, or the like, or any combination thereof) applied to the metal article without damaging a surface of the metal article.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

As used herein, the meaning of "a," "an," or "the" includes singular and plural references unless the context clearly dictates otherwise.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

As used herein, a "plate" generally has a thickness of about 4 millimeters (mm) to about 100 mm. For example, a plate may refer to an aluminum product having a thickness of about 4 mm, about 5 mm, about 10 mm, about 15 mm, about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, or about 100 mm.

As used herein, a "sheet" generally refers to an aluminum product having a thickness of from about 0.2 mm to less than about 4 mm. For example, a sheet may have a thickness of less than 4 mm, less than 3 mm, less than 2 mm, less than 1 mm, less than 0.5 mm, less than 0.3 mm, or less than 0.25 mm.

As used herein, the term "foil" indicates an alloy thickness in a range of up to about 0.2 mm (i.e., 200 microns (μm)). For example, a foil may have a thickness of up to 10 μm, 20 μm, 30 μm, 40 μm, 50 μm, 60 μm, 70 μm, 80 μm, 90 μm, 100 μm, 110 μm, 120 μm, 130 μm, 140 μm, 150 μm, 160 μm, 170 μm, 180 μm, 190 μm, or 200 μm.

In some non-limiting examples, a rolling mill can include at least one work stand, and in some examples, the rolling mill can include multiple stands. For example, the rolling mill may include two stands, three stands, four stands, five stands, six stands, or any other number of stands as needed or desired. Each stand can include a pair of work rolls that are vertically aligned. In some cases, each stand includes a pair of backup rolls that support the pair of work rolls. In some examples, each stand also includes a pair of intermediate rolls. During rolling of the metal article, the metal article is passed through a roll gap defined between the work rolls. Rolling the metal article reduces the thickness of the metal article to a desired thickness and imparts particular properties on the metal article depending on the composition of the metal article. Depending on the desired properties or other considerations for the final metal product, the rolling mill may be run in a hot rolling mode, a cold rolling mode, a warm rolling mode, or any combination thereof.

Hot rolling generally occurs at temperatures above a recrystallization temperature of the metal. For example, in some cases where the metal article is aluminum or an aluminum alloy, hot rolling may occur at a temperature greater than about 250° C., such as from about 250° C. to about 550° C. In other examples, various other temperatures for hot rolling may be used.

In contrast to hot rolling, cold rolling generally occurs at temperatures below the recrystallization temperature of the metal. For example, in some cases wherein the metal article is aluminum or an aluminum alloy, cold rolling may occur at a temperature less than about 200° C., such as from about 20° C. to about 200° C. In other examples, various other temperatures for cold rolling may be used.

In some cases, a metal article may be rolled through a warm rolling process, which occurs at a temperature below the recrystallization temperature of the metal but above the cold rolling temperature. For example, in some cases where the metal article is aluminum or an aluminum alloy, warm rolling may occur at a temperature from about 200° C. to about 250° C. In other examples, various other temperatures for warm rolling may be used.

In some examples, the rolling mill includes a metal article cooling system that is configured to apply a coolant to the outer surface of the metal article to control a temperature of the metal article. In some non-limiting examples, the coolant is water, oil, gel, or any suitable heat transfer medium. In some cases, the coolant is an organic heat transfer medium, a silicone fluid heat transfer medium, or a glycol-based heat transfer medium (e.g., ethylene glycol, propylene glycol, any other polyalkylene glycol, or any combination thereof), or the like. Although this description is provided in the context of liquid coolants, the systems and methods described herein can be used for any viscous materials, including coolants, cleaners, pretreatments, lubricants (e.g., gels, sol-gels, and certain glasses), or the like.

In some examples, the metal article cooling system is configured to reduce a temperature of the metal article during processing. In various examples, the metal article cooling system includes a metal article cooling header that is configured to apply a coolant on at least one surface of the metal article to control the temperature of the metal article. In some examples, the metal article cooling system also includes a viscous material removal system for removing coolant or other viscous material (e.g., pretreatment, cleaner, lubricant, etc.) from a desired area on the metal article (i.e., drying the metal article), and/or for containing the coolant or other viscous material to a desired area on the metal article. In various examples, depending on the configuration of the rolling mill, any number of roll cooling headers and viscous material removal systems may be utilized. The metal article cooling system may be provided at various locations within the rolling mill such as below the metal article, above the metal article, beside the metal article in a vertical rolling mill, combinations thereof, or any suitable location where cooling is desired and the coolant or other viscous material is to be removed before the metal article enters a subsequent work stand or other processing equipment. In some non-limiting examples, the metal article can be metal coil, a metal strip, a metal plate, a metal sheet, a metal foil, a metal billet, a metal ingot, or the like.

In some further examples, the rolling mill includes a cleaning system that is configured to apply a cleaner to the outer surface of the metal article to remove contaminants that can collect on the metal article. In some examples, the cleaning system is configured to apply solvents, detergents, surfactants, acids, bases, any other suitable surface cleaning agent, or any combination thereof, onto at least a first surface of the metal article during processing. In various examples, the metal article cleaning system includes a metal article cleaning header that is configured to apply the cleaner on at least one surface of the metal article to remove oils and/or debris from the surface of the metal article. In some examples, the metal article cleaning system also includes a cleaner and/or a contaminant removal system for removing the cleaner and/or contaminants from a desired area on the metal article (i.e., drying and/or wiping the metal article), and/or for containing the cleaner and/or contaminants to a desired area on the metal article. In various examples, depending on the configuration of the rolling mill, any number of roll cleaning headers and cleaner and/or contaminant removal systems may be utilized. The metal article cleaning system may be provided at various locations within the rolling mill such as below the metal article, above the metal article, beside the metal article in a vertical rolling mill, combinations thereof, or any suitable location where cleaning is desired and the cleaner and/or contaminants are to be removed before the metal article enters a subsequent work stand or other processing equipment.

Likewise, in some further examples, the rolling mill includes a pretreating system that is configured to apply a pretreatment to the outer surface of the metal article to prepare the outer surface of the metal article for certain downstream processing. In some examples, the pretreating system is configured to apply adhesion promoters, corrosion inhibitors, aesthetic films, or any other suitable surface pretreatment agent onto at least a first surface of the metal article during processing. In various examples, the metal article pretreating system includes a metal article pretreating header that is configured to apply the pretreatment on at least one surface of the metal article. In some examples, the metal article pretreating system also includes a removal system for removing any excess pretreatment from a desired area on the metal article (i.e., drying the metal article), and/or for containing the pretreatment to a desired area on the metal article. In various examples, depending on the configuration of the rolling mill, any number of roll pretreating headers and excess pretreatment removal systems may be utilized. The metal article pretreating system may be provided at various locations within the rolling mill such as below the metal article, above the metal article, beside the metal article in a vertical rolling mill, combinations thereof, or any suitable location where pretreating is desired and the excess pretreatment is to be removed before the metal article enters a subsequent work stand or other processing equipment.

In certain aspects, the metal article can be a generally planar metal article. However, during certain processing steps performed at elevated temperatures (e.g., hot rolling, warm rolling, cold rolling, solutionizing, annealing, and/or homogenizing), the metal article or portions of the metal article can become non-planar. In certain examples, the metal article can be heated to temperatures that can provide a soft metal (e.g., heated to temperatures close to a liquidus temperature of the metal article). Heating the metal article can provide a metal article having a non-planar cross-sectional shape (e.g., a bowed shape along a width of the metal article). Such a non-planar cross-sectional shape can result, for example, from processing lines providing more tension along a center of the metal article than along a first edge and/or a second edge of the metal article as the metal article moves from a first work stand to a second work stand. Thus, in a processing line where the metal article is held substantially horizontal, the center of the metal article can be higher in a vertical direction than a first edge and/or a second edge of the metal article. Likewise, in some other examples, in processing lines providing a higher tension along the first edge and/or the second edge than along the center of the metal article as the metal article moves from a first work stand to a second work stand, the center of the metal article can sag and be lower in a vertical direction than the first edge and/or the second edge of the metal article. In some cases, tension in a processing line can vary providing variable vertical heights along a width of a metal article being processed in a processing line wherein the metal article is held substantially horizontal and moving in a direction along a length of the metal article. Such varying vertical heights can provide a dynamic horizontal profile across the width of the metal article. For example, as the metal article moves in a horizontal processing line, a profile of the width of the metal article at a particular processing point (e.g., a point where coolant is applied) can vary constantly.

In some cases, cooling the metal article after processing steps that require heating the metal article can provide a non-planar cross-sectional shape and/or surface irregularities in at least a portion of the metal article where the coolant can be applied. The surface irregularities can provide a surface topography comprising of various elevations across the surface (e.g., ridges and valleys). The non-planar cross-sectional shape and/or surface irregularities can pose challenges with uniformly removing the coolant from the metal article.

In some further examples, a roll cooling system can be provided in at least one work stand and can be configured to reduce a temperature of the roll during processing. In some examples, the roll can be a work roll, a backup roll, or the like. In some cases, the work roll can be stainless steel, steel, or made of any suitable material. In various examples, the roll cooling system includes a roll cooling header that is configured to apply a coolant on at least one surface of the roll to control the temperature of the roll. In some examples, the roll cooling system also includes a viscous material removal system for removing coolant from a desired area and/or for containing the coolant to a desired area on the roll. In various examples, depending on the configuration of the rolling mill, any number of roll cooling systems may be utilized. The roll cooling system may be provided at various locations within the rolling mill such as at a work stand, before a first work stand, after a last work stand, between work stands, etc. In some non-limiting examples, the metal article cooling system and the roll cooling system can be separate or combined systems.

As described herein, the viscous material removal system for removing a liquid coolant from a metal article and/or a roll can include a seal and a biasing mechanism. In some non-limiting examples, the seal can be a flexible seal. For example, the seal can be a polymer seal. Exemplary polymers for use in the polymer seal include, for example, synthetic rubber (styrene-butadiene), natural rubber, elastomers, cellulose, or the like, or any combinations thereof. In some examples, the seal can be a polysilicon seal, a fabric seal, or a seal made of any suitable material that will not damage the metal article and/or the roll when contacting the metal article and/or the roll. The seal can have ample flexibility such that the seal can conform or generally conform to any non-planar cross-sectional shape and/or surface irregularities (e.g., topography) as described above. In some examples, the seal can conform to any non-planar cross-sectional shape and/or surface irregularities by applying a force via at least one biasing mechanism to drive the seal toward the metal article.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic of a viscous material removal system 100 as described herein. The viscous material removal system 100 can be employed to remove a viscous material (e.g., a coolant, a cleaner, a lubricant, a pretreatment or the like) from a roll processed material (e.g., a metal article, a polymer film, or any suitable roll processed material requiring application, optional containment, and removal of a viscous material) and/or contain the viscous material to a desired area on the metal article. In some examples, the metal article is aluminum, aluminum alloys, magnesium, magnesium-based materials, titanium, titanium-based materials, copper, copper-based materials, steel, steel-based materials, bronze, bronze-based materials, brass, brass-based materials, composites, sheets used in composites, or any other suitable metal or combination of materials. The article may include monolithic materials, as well as non-monolithic materials such as roll-bonded materials, clad materials, composite materials (such as but not limited to carbon fiber-containing materials), or various other materials. In some examples, the metal article is a metal coil, a metal strip, a metal plate, a metal sheet, a metal billet, a metal ingot, or the like. In some cases, the systems and methods described herein can be used with a non-metal article. As shown in FIG. 1, the viscous material removal system 100 includes a flexible seal 110 having a width Wand a biasing mechanism. The biasing mechanism can be any desired biasing mechanism such as a plurality of actuators 120 in the example of FIG. 1. The seal 110 can attach to the plurality of actuators 120 by any suitable mounting device, including but not limited to a clip, a pin, a clasp, or a clamp 130. In other examples, the biasing mechanism can be a plurality of springs, a fillable bladder as described below, a curved bar as described below, or any other biasing mechanism that allows a vertical height of the seal to change in a height direction H along the width W of the seal 110. The seal 110 can be flexible, and have a degree of flexibility such that the seal 110 can conform to any non-planar cross-sectional shape and/or surface irregularities in the metal article. The seal 110 can be formed of any suitable material. For example, the seal 110 can be a polymer seal. Polymers for use in the polymer seal include, for example, synthetic rubber (styrene-butadiene), natural rubber, elastomers, cellulose, or the like, or any combinations thereof. In some examples, the seal can be a polysilicon seal, a fabric seal, or a seal made of any suitable material that will not damage the metal article and/or a work roll (e.g., in certain aspects wherein the viscous material removal system is employed to remove viscous material from a work roll).

Figure 2:
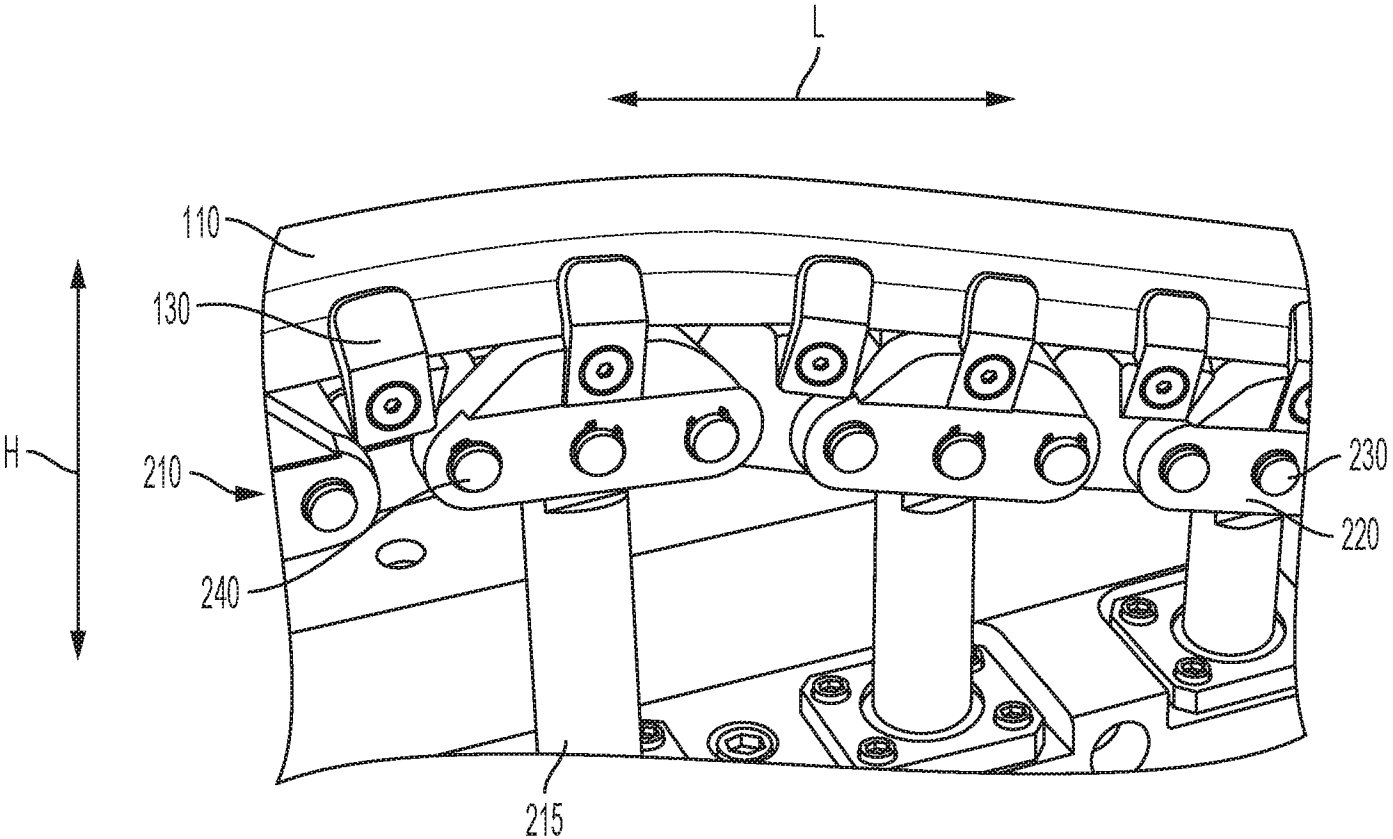
FIG. 2 is a schematic of a close-up view of a portion of a viscous material removal system according to certain aspects of the present disclosure.

The plurality of actuators 120 can include pneumatic actuators, electrical actuators, hydraulic actuators, mechanical actuators, magnetic actuators, thermal actuators, or the other suitable actuator. In some cases, the plurality of actuators 120 can be attached to the seal 110 in any suitable manner including via a plurality of mounting devices 210 (see FIG. 2). In some non-limiting examples, each mounting device 210 can include a mounting arm 215, a pivoting base 220, a pivot pin 230 and a clamp 130. In some cases, each mounting device 210 can be attached to the mounting arm 215 by the pivot pin 230, thus allowing the pivoting base 220 to pivot about the pivot pin 230. Each mounting device 210 can be attached to a successive mounting device 210 by a ligature pin 240, thus allowing each mounting device 210 to pivot with respect to each successive mounting device 210. The succession of mounting devices 210 attached to the plurality of actuators 120 can provide (i) ample pressure to contact the metal article and (ii) ample flexibility to conform to any non-planar cross-sectional shapes and/or surface irregularities occurring in the metal article during processing. In some aspects, ample pressure is a force applied by the plurality of actuators 120 such that the seal 110 can exert a pressure onto the metal article. For example, the plurality of actuators 120 can apply pressure in a range of from about 40 pounds per square inch (psi) to about 120 psi, or up to the maximum air pressure available at a production facility. For example, the plurality of actuators 120 can apply a pressure of about 40 psi, 41 psi, 42 psi, 43 psi, 44 psi, 45 psi, 46 psi, 47 psi, 48 psi, 49 psi, 50 psi, 51 psi, 52 psi, 53 psi, 54 psi, 55 psi, 56 psi, 57 psi, 58 psi, 59 psi, 60 psi, 61 psi, 62 psi, 63 psi, 64 psi, 65 psi, 66 psi, 67 psi, 68 psi, 69 psi, 70 psi, 71 psi, 72 psi, 73 psi, 74 psi, 75 psi, 76 psi, 77 psi, 78 psi, 79 psi, 80 psi, 81 psi, 82 psi, 83 psi, 84 psi, 85 psi, 86 psi, 87 psi, 88 psi, 89 psi, 90 psi, 91 psi, 92 psi, 93 psi, 94 psi, 95 psi, 96 psi, 97 psi, 98 psi, 99 psi, 100 psi, 101 psi, 102 psi, 103 psi, 104 psi, 105 psi, 106 psi, 107 psi, 108 psi, 109 psi, 110 psi, 111 psi, 112 psi, 113 psi, 114 psi, 115 psi, 116 psi, 117 psi, 118 psi, 119 psi, 120 psi, or greater, or anywhere in between.

In some cases, air pressure supplied to the plurality of actuators 120 can provide a working pressure applied by the seal 110 onto the metal article. In some examples, the working pressure can be from about 2 pounds of force per linear inch (lb/in) of the width W of the seal 110 to about 50 lb/in. For example, the working pressure can be about 2 lb/in, 4 lb/in, 6 lb/in, 8 lb/in, 10 lb/in, 12 lb/in, 14 lb/in, 16 lb/in, 18 lb/in, 20 lb/in, 22 lb/in, 24 lb/in, 26 lb/in, 28 lb/in, 30 lb/in, 32 lb/in, 34 lb/in, 36 lb/in, 38 lb/in, 40 lb/in, 42 lb/in, 44 lb/in, 46 lb/in, 48 lb/in, 50 lb/in, greater than 50 lb/in, or anywhere in between. In some aspects, applying the working pressure can allow the seal 110 to maintain contact with the metal article across its width W without buckling the seal 110 (e.g., applying a working pressure that is too high can drive the seal 110 into the metal article, thus deforming the shape of the seal 110 and creating areas where the seal 110 loses contact with the metal article and viscous material can pass beneath or around the seal 110).

Figure 3:
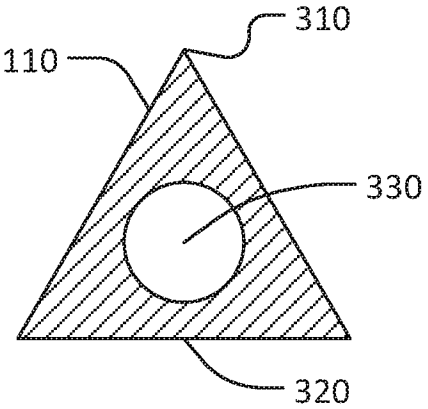
FIG. 3 is a schematic cross-sectional view of a seal according to certain aspects of the present disclosure.

FIG. 3 is a schematic of one example of a seal 110 as described herein. In some cases, the seal 110 can have a triangular shape (though it need not) where one edge can be a contacting edge 310 and another edge can be a mounting edge 320. For example, the mounting edge 320 can be held by the clamp 130 (see FIG. 1). In some cases, the clamp 130 can hold the seal 110 such that the seal 110 can move in a lateral direction L along the width W of the seal 110 while simultaneously being prevented from exiting the clamp 130 in a substantially vertical direction, as in the example of FIG. 4 (e.g., referring to FIG. 2, the seal 110 can slide side-to-side in the lateral direction L within each clamp 130 without escaping vertically out of each clamp 130). In some non-limiting examples, the seal 110 can be hollow, containing a void 330 in a cross-sectional center of the seal 110. In some aspects, the void 330 can allow the seal 110 to compress when contacting the metal article. Allowing the seal 110 to compress can further allow the seal 110 to enter into/conform to irregularities and defects in the metal article surface as elasticity of the seal 110 drives the seal 110 to return to its uncompressed state, further driving the contacting edge 310 into the surface of the metal article. In some cases, the seal 110 is solid and does not contain a void.

Figure 4:
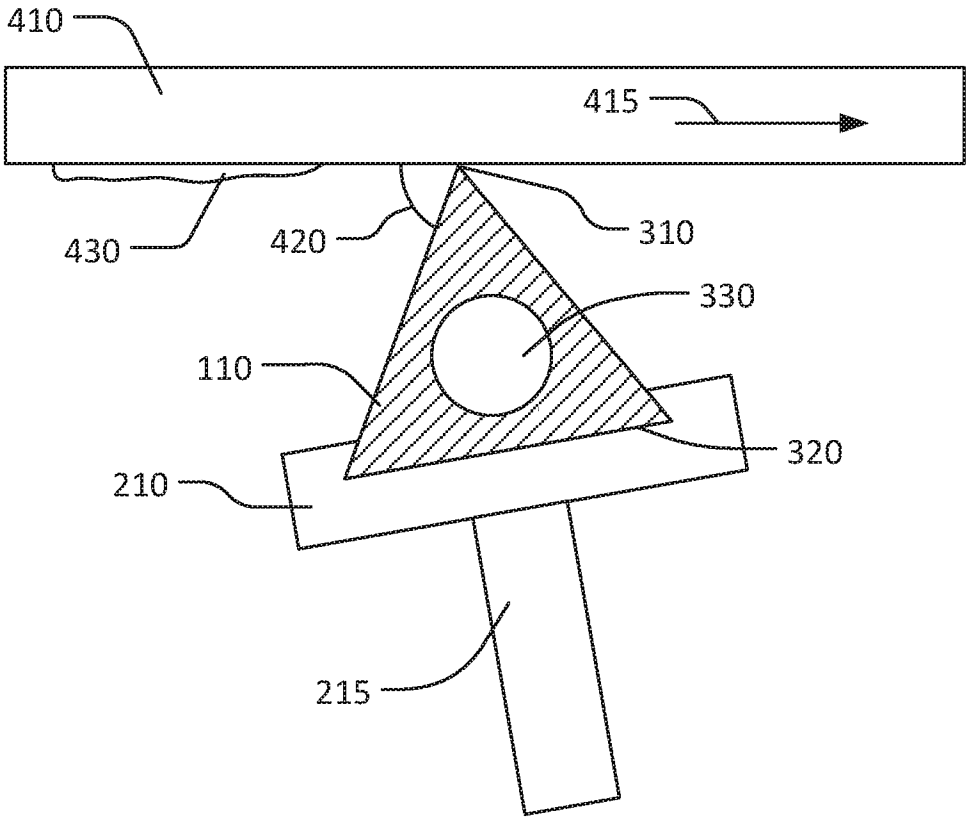
FIG. 4 is a schematic cross-sectional view of the seal of FIG. 3 contacting a material article according to certain aspects of the present disclosure.

When in a first position in the example of FIG. 4, the contacting edge 310 of the seal 110 contacts the metal article 410. The seal 110, the mounting device 210 and the mounting arm 215 are positioned such that an angle 420 between the metal article 410 and a leading face of the seal 110 is from about 15° to about 90°. For example, the angle 420 can be an angle of about 15°, 16°, 17°, 18°, 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, or 90°, or anywhere in between. In some further examples, the angle 420 can vary based on a shape of the seal 110 and can be apparent to a person of skill in the art. For example, a seal 110 having a knife blade shape can contact the metal article 410 at an angle 420 that is from about 0° to about 90° (e.g., 0°, 1°, 2°, 3°, 4°, 5°, 6°, 7°, 8°, 9°, 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, 90°, or anywhere in between). In still further examples, a seal 110 having a circular cross sectional shape and a round contacting edge can contact the metal article 410 at any suitable angle 420 such that the mounting device 210 does not contact the metal article 410.

In some non-limiting examples, the metal article 410 can pass over the seal 110 in a direction 415 during a processing step as described above. Pressure can be applied by the plurality of actuators 120 such that the seal 110 can remain in constant contact with the metal article 410 across the width of the metal article 410, even in areas where the metal article 410 is curved or has irregularities. The plurality of actuators 120 can apply pressure along the width W of the seal 110 such that the seal 110 can move into a plurality of second positions (i.e., each individual actuator can move a portion of the seal 110 attached to that individual actuator into an individual second position, see FIG. 1) forcing the seal 110 to conform to a shape of the metal article 410 across the width of the metal article 410. As described above, each clamp 130 is configured to allow the seal 110 to move in the lateral direction L (see FIG. 2) along the width W of the seal 110 (e.g., each clamp 130 grasps the seal 110 sufficiently loosely to allow the seal 110 to slide side-to-side without exiting vertically from each clamp 130). Allowing the seal 110 to move in the lateral direction L further allows the seal 110 to move in the height direction H into the plurality of second positions without stressing the seal 110 along the width W of the seal 110. In this way, a vertical position of the seal 110 can vary across the width W of the seal 110, as in the example of FIG. 1. In some non-limiting examples, the plurality of actuators 120 can force the seal 110 to conform to a bowed shape, a concave shape, a convex shape, a sinusoidal shape, or any suitable shape a metal article 410 can assume during processing. In some examples, forcing the seal 110 to conform to the shape of the metal article 410 can prevent any viscous material 430 applied to the metal article 410 from passing the seal 110, thus providing removal of the viscous material 430 from the metal article 410.

In some examples, instead of a plurality of actuators, the biasing mechanism can be a fillable bladder. The fillable bladder can be filled with any suitable fluid medium (e.g., water, air, gel, or the like, or any combination thereof). The seal 110 can be mounted to the fillable bladder by any suitable mounting device. The fillable bladder can be filled to apply a pressure such that the seal can remain in constant contact with the metal article 410 by conforming to a shape of the metal article 410 across the width of the metal article 410. In some examples, the fillable bladder can act as a seal by contacting a contacting edge of the fillable bladder to the metal article 410. In some aspects, the fillable bladder can compress when contacting the metal article 410. Allowing the fillable bladder to compress can further allow the fillable bladder to enter into/conform to irregularities and defects in the metal article 410 surface as elasticity of the fillable bladder drives the fillable bladder to return to its uncompressed state, further driving the contacting edge of the fillable bladder into the surface of the metal article 410.

In other examples, the biasing mechanism can be a curved bar. The seal 110 can be mounted to the curved bar by any suitable mounting device. The curved bar can be placed adjacent to the metal article 410 such that the seal 110 is pressed against the metal article 410 and can remain in constant contact with the metal article 410 during processing.

The biasing mechanism is not limited to the examples described above, but can be any structure that allows a seal to conform to a non-planar metal article or a metal article with surface irregularities across at least a portion of the width of the metal article.

Figure 5:
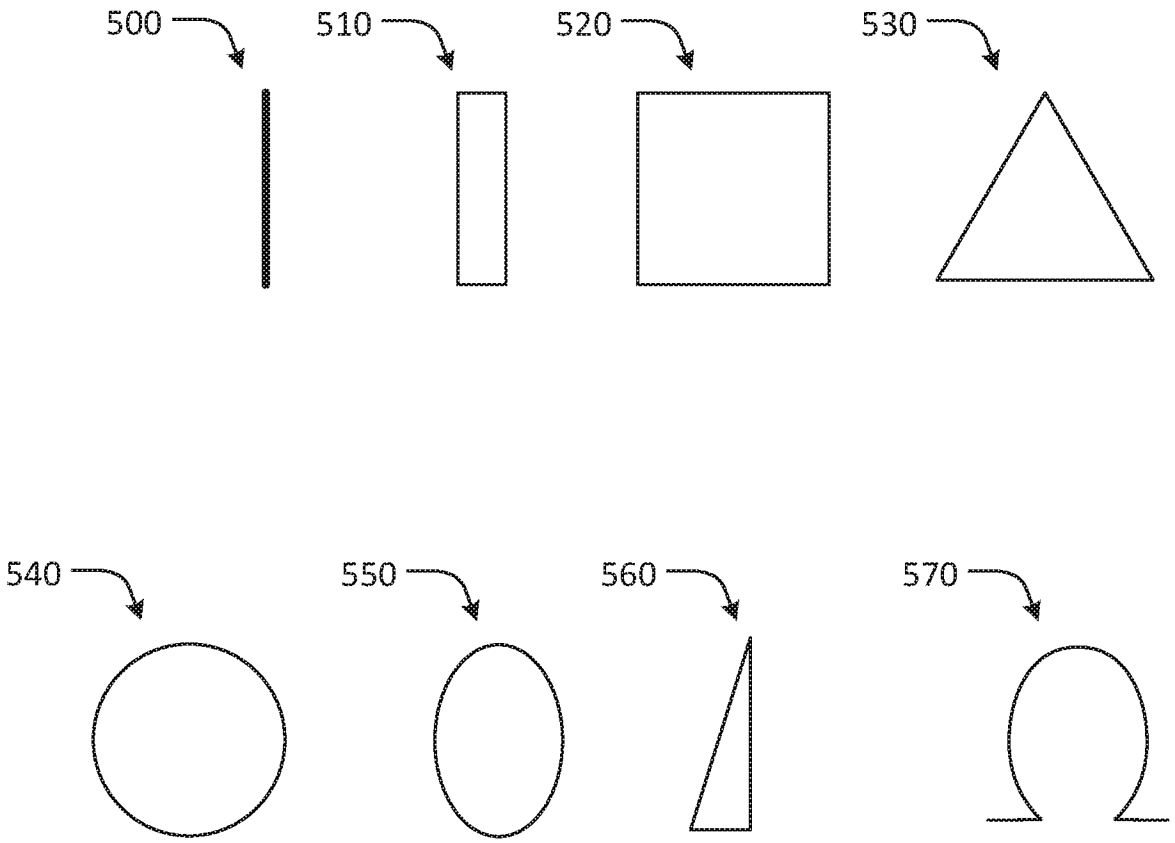
FIG. 5 shows schematic cross-sectional views of exemplary seals according to certain aspects of the present disclosure.

The seal 110 can have any suitable cross-sectional shape. As shown in FIG. 5, some non-limiting examples of the shape of the seal include a line 500, a rectangle 510, a square 520, a triangle 530, a circle 540, an ellipse 550, a knife blade 560, or the Greek capital letter omega 570.

The viscous material removal system 100 can be a compact system when compared to existing cooling and coolant containment systems. In some non-limiting examples, the viscous material removal system 100 can be positioned at any desired position adjacent to the metal article such that the coolant (or, for example, any viscous material applied to a metal article during roll processing) can be removed. In some examples, the viscous material removal system 100 can be positioned adjacent to any roll in a rolling mill, or may be positioned before or after any roll in a rolling mill. In some aspects, the viscous material removal system 100 can be positioned adjacent to any roll requiring cooling using a liquid coolant. The viscous material removal system 100 can be placed adjacent to an upper work roll, a lower work roll, an upper backup roll, a lower backup roll, a first work roll in a vertical rolling mill, a second work roll in a vertical rolling mill, a first backup roll in a vertical rolling mill, a second backup roll in a vertical rolling mill, or any roll requiring cooling using a liquid coolant (or, for example, application of any viscous material a roll may require).

As used below, any reference to a series of examples is to be understood as a reference to each of those examples disjunctively (e.g., "Examples 1-4" is to be understood as "Examples 1, 2, 3, or 4").

Example 1 is a system for removing a viscous material from a surface of a material article, comprising: a flexible seal that is movable in a direction substantially normal to the surface along a width of the flexible seal between a first position and at least one second position, wherein the flexible seal is configured to contact the surface along the width of the flexible seal; and a biasing mechanism configured to move select portions of the flexible seal along the width of the flexible seal to conform the flexible seal to the surface across a width of the surface.

Example 2 is the system of any preceding or subsequent example, further comprising the material article, wherein the material article is at least one of a moving material article or a metal article.

Example 3 is the system of any preceding or subsequent example, wherein the flexible seal is movable in a direction normal to the material article along a width of the flexible seal between the first position and a plurality of other variable positions.

Example 4 is the system of any preceding or subsequent example, wherein the biasing mechanism is a static biasing mechanism or a movable biasing mechanism.

Example 5 is the system of any preceding or subsequent example, wherein the movable biasing mechanism comprises a plurality of portions that move independently of each other or that move in concert with each other.

Example 6 is the system of any preceding or subsequent example, wherein the static biasing mechanism comprises a curved bar, wherein a convex side of the curved bar contains a mount for the flexible seal, wherein the flexible seal is pressed against the material article by positioning the curved bar adjacent to the material article.

Example 7 is the system of any preceding or subsequent example, wherein the movable biasing mechanism comprises at least one of: a plurality of actuators; a plurality of springs; or a fillable bladder fillable with a fluid medium.

Example 8 is the system of any preceding or subsequent example, further comprising a plurality of mounting devices, wherein an individual mounting device of the plurality of mounting devices is attached to an individual actuator or a subset of the plurality of actuators or an individual mounting device is attached to an individual spring or a subset of the plurality of springs, or the plurality of mounting devices is attached to the fillable bladder.

Example 9 is the system of any preceding or subsequent example, wherein the plurality of mounting devices comprises at least one of clamps, clips, pins, or clasps.

Example 10 is the system of any preceding or subsequent example, wherein the plurality of actuators comprises at least one of pneumatic actuators, electrical actuators, hydraulic actuators, mechanical actuators, magnetic actuators, or thermal actuators.

Example 11 is the system of any preceding or subsequent example, wherein the biasing mechanism is configured to position the flexible seal such that a first portion of the flexible seal has a height that is different from a height of a second portion of the flexible seal.

Example 12 is the system of any preceding or subsequent example, wherein the flexible seal is configured to traverse at least partially across the width of the material article.

Example 13 is the system of any preceding or subsequent example, wherein the flexible seal is configured to traverse entirely across the width of the material article.

Example 14 is the system of any preceding or subsequent example, wherein the flexible seal further comprises: a body; a contacting edge; and a mounting edge, wherein the mounting edge is disposed opposite the contacting edge across the body.

Example 15 is the system of any preceding or subsequent example, wherein the body, the contacting edge, and the mounting edge define a cross-sectional shape that is selected from the group consisting of a line, a rectangle, a square, a triangle, a circle, an ellipse, a knife blade, a Greek capital letter omega, or any combinations thereof.

Example 16 is the system of any preceding or subsequent example, wherein the flexible seal has a degree of flexibility such that the contacting edge conforms to a curved cross-sectional shape of the material article, and a surface topography of the material article during processing.

Example 17 is a method of removing a viscous material from a material article, comprising: mounting a seal onto a biasing mechanism; placing the seal mounted on a biasing mechanism adjacent to the material article such that a contacting edge of the seal contacts the material article; and applying pressure from the biasing mechanism such that the seal maintains contact with the material article across a width of the seal.

Example 18 is the method of any preceding or subsequent example, wherein placing the seal mounted on a biasing mechanism adjacent to the material article further comprises placing the seal mounted on a biasing mechanism adjacent to an area on the material article having a viscous material applied to the material article.

Example 19 is the method of any preceding or subsequent example, further comprising passing the material article over the seal mounted on a biasing mechanism and contacting the material article.

Example 20 is the method of any preceding or subsequent example, wherein applying pressure from the biasing mechanism further comprises allowing the seal to conform to a cross-sectional shape of the material article and a surface topography of the material article across the width of the seal.

Example 21 is the method of any preceding or subsequent example, further comprising using the biasing mechanism to position the seal such that a first portion of the seal has a height that is different from a height of a second portion of the seal.

Example 22 is the method of any preceding example, wherein the viscous material applied to the material article is preventing from passing the seal.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A system for removing a viscous material from a surface of a material article, the system comprising:

a processing direction, wherein the system is configured to receive the material article moving in the processing direction;

a lateral direction extending transversely to the processing direction and corresponding to a width of the material article;

a flexible seal extending in the lateral direction, wherein the flexible seal is adjustable in a vertical direction and the lateral direction, wherein the flexible seal is configured to contact the surface in the lateral direction; and a biasing mechanism configured to bias select portions of the flexible seal such that the flexible seal is conformable to the surface in the lateral direction.

2. The system of claim 1, further comprising the material article, wherein the material article is at least one of a moving material article or a metal article.

3. The system of claim 1, wherein the flexible seal is movable between a first position and a plurality of other variable positions.

4. The system of claim 1, wherein the biasing mechanism is a static biasing mechanism or a movable biasing mechanism.

5. The system of claim 4, wherein the movable biasing mechanism comprises a plurality of portions that move independently of each other or that move in concert with each other.

6. The system of claim 4, wherein the static biasing mechanism comprises a curved bar, wherein a convex side of the curved bar contains a mount for the flexible seal, and wherein the biasing mechanism is configured to press the flexible seal against the material article by positioning the curved bar adjacent to the material article.

7. The system of claim 4, wherein the movable biasing mechanism comprises at least one of:

a plurality of actuators;

a plurality of springs; or a fillable bladder fillable with a fluid medium.

8. The system of claim 7, further comprising a plurality of mounting devices, wherein an individual mounting device of the plurality of mounting devices is attached to at least one actuator of the plurality of actuators, at least one spring of the plurality of springs, or the fillable bladder.

9. The system of claim 7, wherein the plurality of actuators comprises at least one of pneumatic actuators, electrical actuators, hydraulic actuators, mechanical actuators, magnetic actuators, or thermal actuators.

10. The system of claim 8, wherein the plurality of mounting devices comprises at least one of clamps, clips, pins, or clasps.

11. The system of claim 1, wherein the biasing mechanism is configured to position the flexible seal such that a first portion of the flexible seal has a height that is different from a height of a second portion of the flexible seal.

12. The system of claim 1, wherein the flexible seal is configured to traverse at least partially across the width of the material article.

13. The system of claim 12, wherein the flexible seal is configured to traverse entirely across the width of the material article.

14. The system of claim 1, wherein the flexible seal further comprises:

a body;

a contacting edge; and a mounting edge, wherein the mounting edge is disposed opposite the contacting edge across the body.

15. The system of claim 14, wherein the body, the contacting edge, and the mounting edge define a cross-sectional shape that is selected from the group consisting of a line, a rectangle, a square, a triangle, a circle, an ellipse, a knife blade, a Greek capital letter omega, or any combinations thereof.

16. The system of claim 14, wherein the flexible seal has a degree of flexibility such that the contacting edge is configured to conform to a curved cross-sectional shape of the material article and a surface topography of the material article during processing.

* * * * *